US008690390B1

(12) United States Patent
Matus Calleros

(10) Patent No.: US 8,690,390 B1
(45) Date of Patent: Apr. 8, 2014

(54) LAMP AND FAN MODEL

(71) Applicant: Luciano Matus Calleros, Delegacion Cuauhtemoc (MX)

(72) Inventor: Luciano Matus Calleros, Delegacion Cuauhtemoc (MX)

( * ) Notice: Subject to any disclaimer, the term of this patent is extended or adjusted under 35 U.S.C. 154(b) by 9 days.

(21) Appl. No.: 13/659,742

(22) Filed: Oct. 24, 2012

(51) Int. Cl.
*F21V 33/00* (2006.01)
*F21L 27/00* (2006.01)

(52) U.S. Cl.
USPC ..... 362/253; 362/186; 362/189

(58) Field of Classification Search
USPC ..... 362/253, 186–191
See application file for complete search history.

(56) References Cited

U.S. PATENT DOCUMENTS 7,344,267 B2 * 3/2008 Carito ..... 362/189

FOREIGN PATENT DOCUMENTS

FR 2570049 A * 3/1986
JP 11081252 A * 3/1999

* cited by examiner

*Primary Examiner* — Mariceli Santiago
(74) *Attorney, Agent, or Firm* — Cook Alex Ltd.

(57) ABSTRACT

The present disclosure relates to a lamp and fan design to generate the comfort and freshness feeling in a room, wherein the lamp and fan is portable and has a lampshade which is not fixed to the lamp but rather remains mobile based on sustainability principles by favoring the arrangement of said lampshade at a variable height relative to the fan.

5 Claims, 3 Drawing Sheets

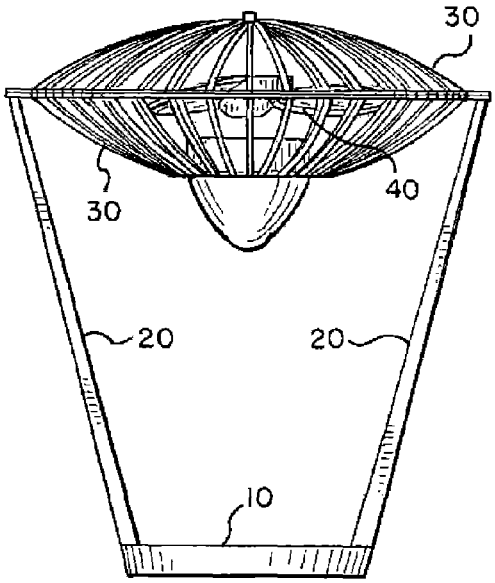
FIG. 1
FIG. 2
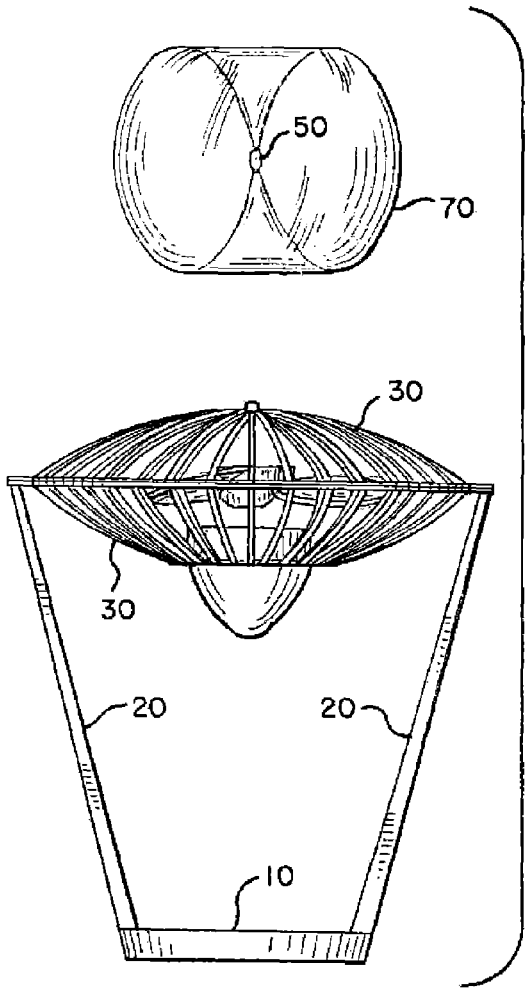

LAMP AND FAN MODEL

BACKGROUND

1. Technical Field

The present invention relates to a lamp and fan combination device or model wherein the lampshade is not fixed to the lamp but rather remains mobile based on sustainability principles as further described below.

2. Description of Related Art

For a long time the combination of fans and lamps has been known, as for example those generally known as and used as ceiling fans. These types of devices, in addition to providing a constant or a variable air flow, further provide efficient lighting which generates on the whole, a comfortable space for the user, as for example that disclosed in Mexican Industrial Design Registration No. 9534.

Also known are lamp and fan designs such as Mexican Patent Application No. MX/a/2007/011000 by Hunter Fan Company in which a fan and lamp are protected. This includes a housing, lighting equipment, and an air exhaust port coupled to an exhaust duct. The powered fan equipment operates at high speed and low speed to aerate, to prevent heat buildup within the housing. The technical problem to be solved by this device is to address heat buildup based on the use of the fan itself; however, the generated air is not employed for the user except at high speed.

The present disclosure however does achieve an important objective of generating a fresh environment for the users, with the combination of a fan and a lamp which is also oriented to the scope of contemplation by the present disclosure because the lampshade of the lamp is kept in motion, being driven by air flow that the fan generates which makes same applicable to many different uses, for example in baby rooms. As a consequence, the present device is useful for decreasing stress or as a decorative object.

The present disclosure is intended to provide a comfortable and fresh environment.

An aspect of the present disclosure is to provide a light and ventilation object that refreshes the environment.

Another aspect of the present disclosure is to generate a lightweight and portable lamp and fan device, whereby it can be shifted from place to place without compromising any of its components.

Another aspect of the present disclosure is to provide an economical ventilation and lamp device that exhibits ease of assembly to make it accessible to any user.

Still another aspect of the present disclosure is to provide a lamp and fan combination that does not require special tools for its assembly or much time to achieve a complete assembly.

Another aspect of the present disclosure is that the lamp and fan are of promotional utility or to provide a promotional object.

BRIEF DESCRIPTION OF THE DRAWINGS

FIG. 1 is a front view of the portable lamp-fan.

FIG. 2 is a front view of the portable lamp-fan with the lampshade thereon.

DETAILED DESCRIPTION

Figure 3:
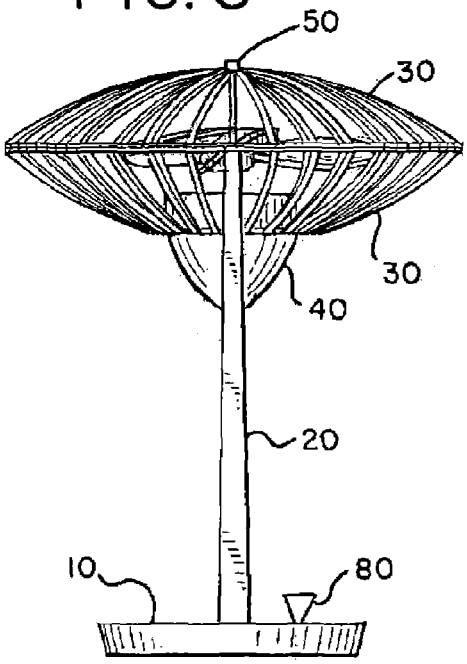
FIG. 3 is a side view of the portable lamp-fan model or device.

The present disclosure consists of a lamp-fan comprising a base. In a preferred embodiment, the base has a bottom 10 and two arms 20. An alternative embodiment may vary to instead have a single arm. Also, the shape of the arms 20 can vary.

At the distal end of the arms 20 is arranged a fan receptacle 30. In a preferred embodiment, the receptacle 30 is fixed on the arms 20 as shown, for example, in FIG. 2.

Inside the receptacle 30 is arranged a fan 40, wherein the purpose of the receptacle is to prevent the user from coming into contact with the fan blades 40. See, for example, FIGS. 2, 3 and 4.

Driving the fan by the motor generates an air stream over the device, above which is arranged the lampshade 70, as shown in FIG. 2. The lampshade 70 has a capricious shape, such as the illustrated generally cylindrical shape. This generally cylindrical embodiment illustrates a key element that is reproducible. As shown, a central axis is formed on the lampshade 70. In a preferred embodiment, the central axis is generated by a mass 50, as shown in FIG. 2.

When the lampshade 70 is disposed on the fan 40, the airflow generates a current flow that keeps the lampshade in balance that supports the lampshade which finds its equilibrium, keeping the lampshade at the same height and is maintained at this specific site, where it is kept in view of the central axis of the lampshade thereby achieving a specific supporting effect because all of the forces involved are in equilibrium with each other. The lampshade remains suspended above the fan component, as shown in FIG. 2.

The lampshade 70 is light enough in weight to be suspended by the air flow and rise thereby. Lampshade 70 also is dense enough so that air flowing specifically around it generates a current that on flowing through the central axis will maintain balance; therefore, the height of the lampshade 70 may be modified to a variety of desired lampshade heights by modifying fan power.

Figure 5:
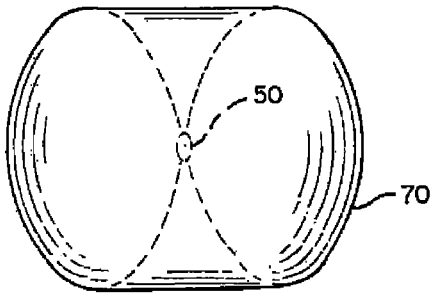
FIG. 5 is a front view of a lampshade of the portable lamp-fan model or device.
Figure 6:
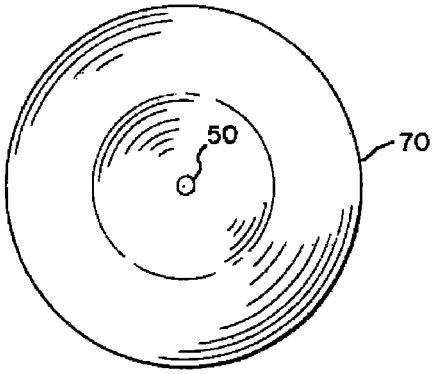
FIG. 6 is a top view of the portable lamp-fan lampshade of the model or device.
Figure 7:
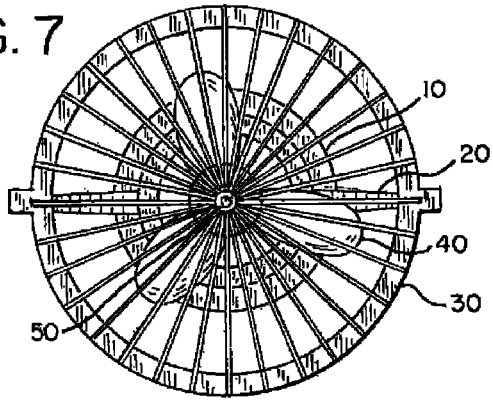
FIG. 7 is a top view of the portable lamp-fan model or device.

In an illustrated embodiment, the lampshade is a balloon made of latex. It will be appreciated that any material with the characteristics aforementioned may work. See FIGS. 2, 5 and 6.

Figure 4:
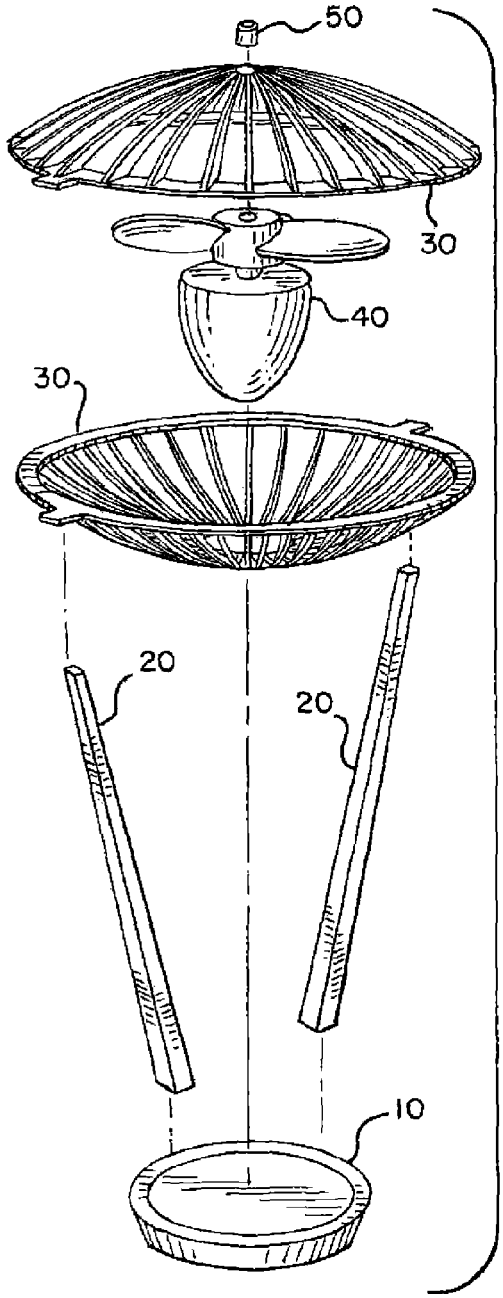
FIG. 4 is an exploded view of the portable lamp-fan model or device.

A luminaire lights the lampshade, and therefore a shadow is generated by the lampshade. Typically, the luminaire, such as shown at 80 in FIG. 3, is positioned at a level below that of the lampshade 70. For example, the luminaire is positioned within or on the rest of the device. Examples of such positioning are on or in the base 10, on or in the arm or arms 20, within the upper and/or lower receptacle members 30, above and/or below the assembled receptacle members 30, and/or on or in the fan assembly. As an example, when the lampshade corresponds to a latex balloon which functions as lampshade, this arrangement can be referred to as an eclipse lamp.

These and other embodiments can be modified at will whereby same should not be understood in a limiting way but merely as examples of embodiments of the invention that will be limited only in accordance with the appended claims.

The invention claimed is:

1. Lamp fan comprising a circular base from which two brackets are projected vertically that define two V-arms, each having an upper end portion, said upper end portions support a fan receptacle formed by the horizontal coupling of two semi-elliptical grids, said fan receptacle houses a fan with rotating blades inside, wherein the receptacle has a central axis defined by a mass disposed on its upper section, a lampshade arranging on the upper grid, so that once the fan is powered, it generates an air stream that elevates and sustains that lampshade.

2. Fan lamp according to claim 1, wherein the lampshade is a latex balloon having an internal axis formed by clamping two faces.

3. Fan lamp according to claim 1, wherein the lampshade is generally cylindrical in shape and includes a central axis.

4. Fan lamp according to claim 3, wherein the generally cylindrical lampshade central axis is generated by a mass.

5. Fan lamp according to claim 1, further including a luminaire associated with the device to thereby illuminate the lampshade.

* * * * *